US007431107B2

(12) United States Patent
Hill et al.

(10) Patent No.: US 7,431,107 B2
(45) Date of Patent: Oct. 7, 2008

(54) CORING BIT WITH UNCOUPLED SLEEVE

(75) Inventors: Bunker Hill, Sugar Land, TX (US); Gary W. Contreras, Valencia, CA (US); Edward Harrigan, Richmond, TX (US); Robert Wayne Sundquist, The Woodlands, TX (US); Lennox E. Reid, Houston, TX (US); Dean W. Lauppe, Pasadena, TX (US); Sony Tran, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/248,475

(22) Filed: Jan. 22, 2003

(65) Prior Publication Data

US 2004/0140126 A1 Jul. 22, 2004

(51) Int. Cl.
*E21B 49/06* (2006.01)
*E21B 25/10* (2006.01)

(52) U.S. Cl. ..... 175/246; 175/249; 175/78

(58) Field of Classification Search ..... 175/58, 175/244, 246, 248, 249, 253, 255, 77, 78
See application file for complete search history.

(56) References Cited

U.S. PATENT DOCUMENTS

| | | | | |
|---|---|---|---|---|
| 366,913 | A | | 7/1887 | Ball |
| 1,830,681 | A | | 11/1931 | Floyd |
| 1,932,612 | A | | 10/1933 | Williston |
| 2,044,057 | A | | 6/1936 | Burt |
| 2,181,980 | A | | 12/1939 | Seale |
| 2,230,568 | A | * | 2/1941 | Howard et al. ..... 175/246 |
| 2,252,620 | A | | 8/1941 | De Long |
| 2,306,369 | A | * | 12/1942 | Anderson ..... 175/249 |
| 2,343,793 | A | | 3/1944 | Paget |
| 2,490,512 | A | | 12/1949 | Deely |
| 2,558,227 | A | * | 6/1951 | Yancey et al. ..... 175/78 |
| 2,738,167 | A | * | 3/1956 | Williams, Jr. ..... 175/246 |
| 2,852,230 | A | * | 9/1958 | Garrison ..... 175/58 |
| 3,092,192 | A | | 6/1963 | Deely |
| 3,428,138 | A | | 2/1969 | Casper et al. |
| 3,537,743 | A | | 11/1970 | Martinsen |
| 3,598,191 | A | * | 8/1971 | Bullard ..... 175/77 |
| 3,964,555 | A | * | 6/1976 | Franklin ..... 175/44 |
| 4,002,213 | A | * | 1/1977 | Sweeney ..... 175/58 |
| 4,258,803 | A | | 3/1981 | Thompson et al. |
| 4,354,558 | A | | 10/1982 | Jageler et al. |
| 4,424,183 | A | | 1/1984 | Nelson |
| 4,518,051 | A | * | 5/1985 | Sollie et al. ..... 175/58 |
| 4,607,710 | A | | 8/1986 | Radford |
| 4,609,056 | A | | 9/1986 | Colle, Jr. et al. |

(Continued)

FOREIGN PATENT DOCUMENTS

| | | | |
|---|---|---|---|
| GB | 2236780 | A | 9/1989 |

(Continued)

*Primary Examiner*—Jennifer H Gay
*Assistant Examiner*—Daniel P Stephenson
(74) *Attorney, Agent, or Firm*—Matthias Abrell; Jaime Castano

(57) ABSTRACT

A coring bit, including an outer hollow coring shaft, and a rotationally uncoupled internal sleeve disposed inside the outer hollow coring shaft. The rotationally uncoupled internal sleeve may be a non-rotating internal sleeve. The rotationally uncoupled internal sleeve may be a free-floating internal sleeve.

27 Claims, 9 Drawing Sheets

U.S. PATENT DOCUMENTS 4,629,011 A 12/1986 Reinhardt
4,667,753 A 5/1987 Jageler
4,669,082 A 5/1987 Tilghman et al.
4,702,168 A 10/1987 Colle, Jr. et al.
4,714,119 A 12/1987 Herbert et al.
4,790,396 A 12/1988 Fuller
4,818,050 A 4/1989 Duthie
4,839,516 A 6/1989 Freeman et al.
4,864,846 A 9/1989 Jones
4,911,002 A 3/1990 Enderlin et al.
4,950,844 A 8/1990 Hallmark et al.
4,969,528 A 11/1990 Jurgens
4,979,576 A 12/1990 Barker et al.
4,981,183 A 1/1991 Tibbitts
4,996,489 A 2/1991 Sinclair
4,996,872 A 3/1991 Mueller et al.
5,025,872 A 6/1991 Behre et al.
5,029,653 A * 7/1991 Jurgens et al. ..... 175/58
5,031,536 A 7/1991 Barker et al.
5,052,502 A 10/1991 Jurgens et al.
5,105,894 A 4/1992 Enderlin
5,146,999 A 9/1992 Wiser et al.
5,163,522 A 11/1992 Eaton et al.
5,230,390 A 7/1993 Zastresek et al.
5,253,719 A 10/1993 Blauch et al.
5,277,062 A 1/1994 Blauch et al.
5,310,013 A 5/1994 Kishino et al.
5,325,723 A 7/1994 Meadows et al.
5,360,074 A 11/1994 Collee et al.
5,411,106 A 5/1995 Maissa et al.
5,439,065 A 8/1995 Georgi
5,482,123 A 1/1996 Collee
5,487,433 A * 1/1996 Mackay et al. ..... 175/78
5,546,798 A 8/1996 Collee et al.
5,554,302 A 9/1996 Carabine
5,560,438 A 10/1996 Collee et al.
5,568,838 A 10/1996 Struthers et al.
5,617,927 A 4/1997 Maissa
5,667,025 A 9/1997 Haessly et al.
5,741,707 A 4/1998 Herron et al.
5,868,030 A 2/1999 Brumley et al.
5,881,825 A 3/1999 Collee et al.
5,957,221 A 9/1999 Hay et al.
6,006,844 A 12/1999 Van Puymbroeck et al.
6,047,239 A 4/2000 Berger et al.
6,283,228 B2 9/2001 Collee et al.
6,341,656 B1 1/2002 Fanuel et al.
6,371,221 B1 4/2002 Harrigan et al.
6,394,196 B1 5/2002 Fanuel et al.
6,401,840 B1 6/2002 Hay et al.
6,412,575 B1 7/2002 Harrigan et al.
2002/0148643 A1 10/2002 Contreras et al.
2003/0173116 A1 9/2003 Wells et al.

FOREIGN PATENT DOCUMENTS

GB 2417045 2/2006
JP 1161129 6/1989
JP 11236709 8/1999
SU 1157220 A * 5/1985

* cited by examiner

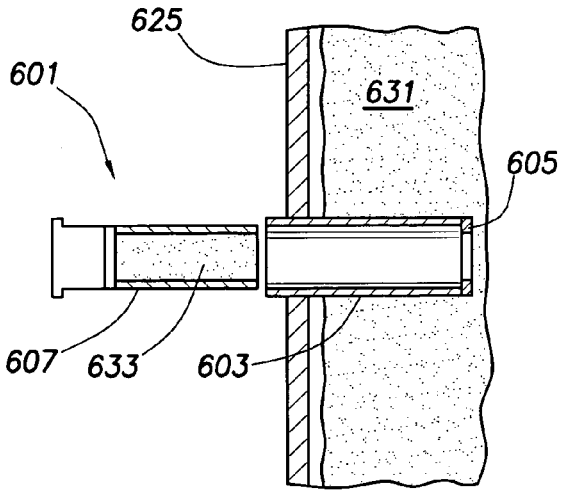
FIG.6C
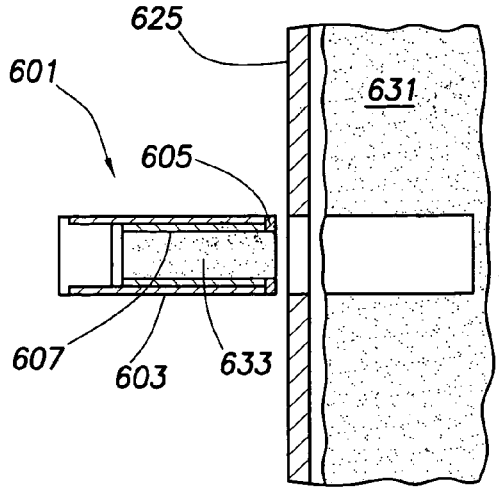
FIG.6D
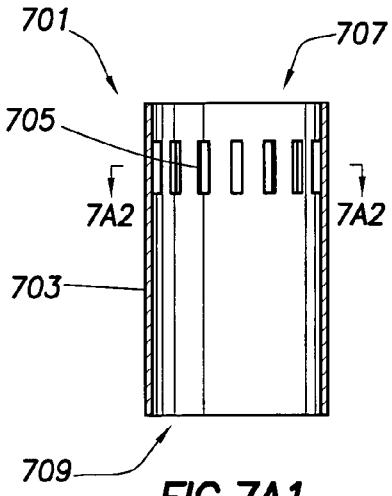
FIG.7A1
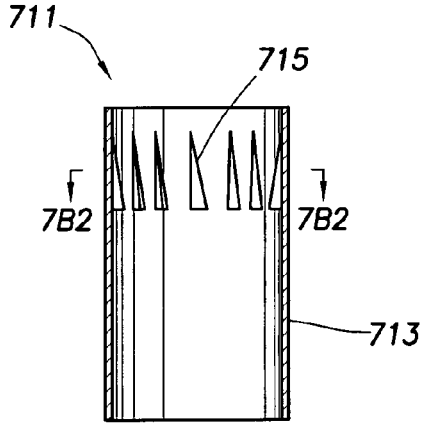
FIG.7B1
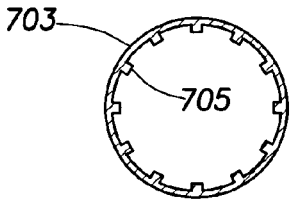
FIG.7A2
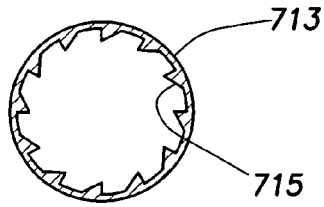
FIG.7B2

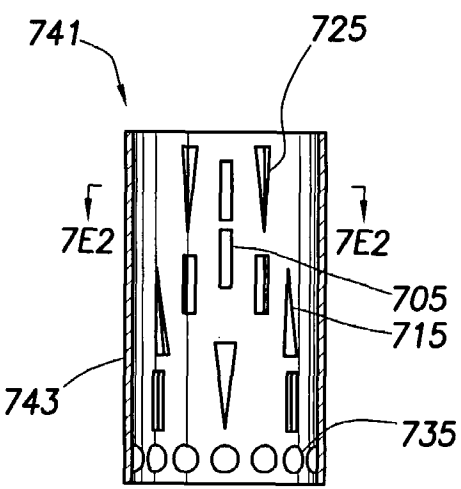
FIG. 7E1
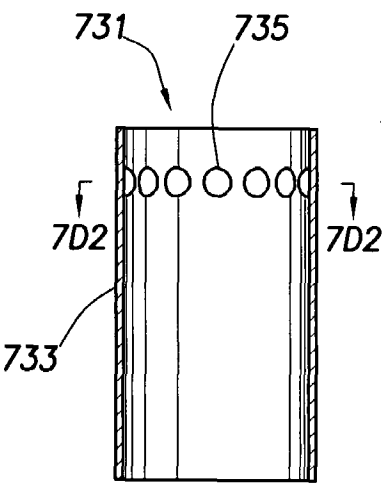
FIG. 7D1
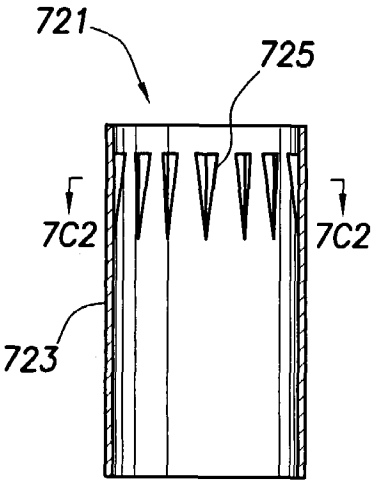
FIG. 7C1
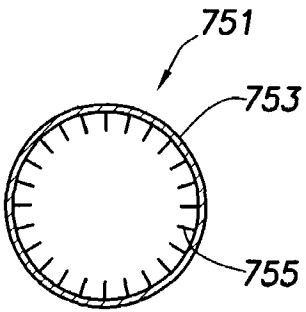
FIG. 7F
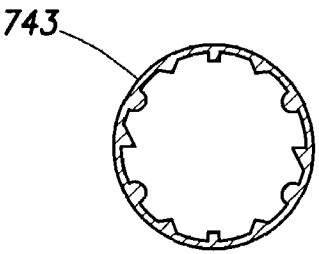
FIG. 7E2
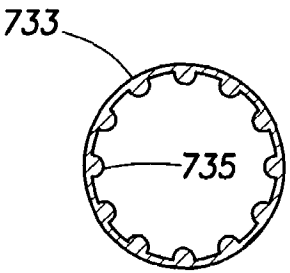
FIG. 7D2
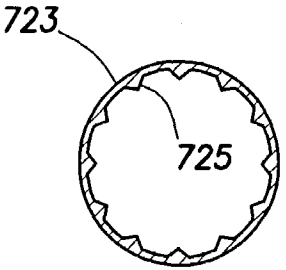
FIG. 7C2

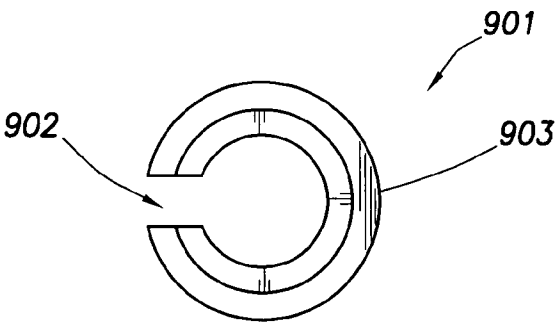
FIG.9A2
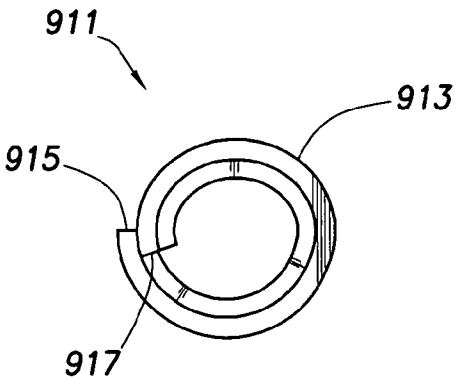
FIG.9B2
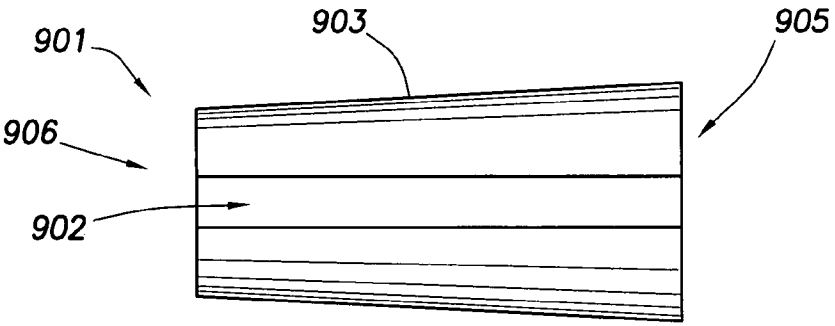
FIG.9A1
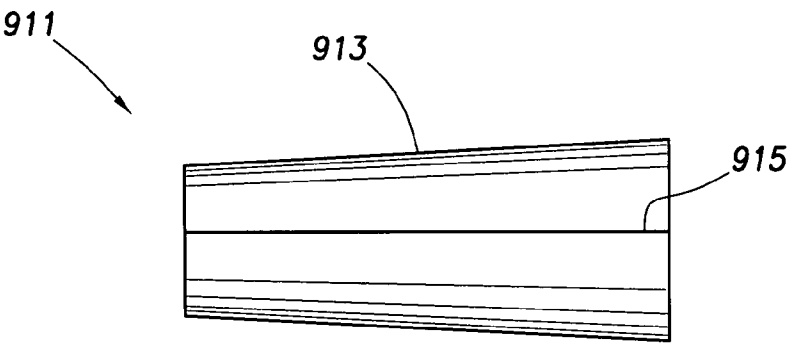
FIG.9B1

CORING BIT WITH UNCOUPLED SLEEVE

BACKGROUND OF INVENTION

Wells are generally drilled into the ground to recover natural deposits of hydrocarbons and other desirable materials trapped in geological formations in the Earth's crust. A slender well is drilled into the ground and directed to the targeted geological location from a drilling rig at the Earth's surface.

Once a formation of interest is reached in a drilled well, drillers often investigate the formations and their contents by taking samples of the formation rock at multiple locations in the well and analyzing the samples. Typically, each sample is cored from the formation using a hollow coring bit, and the sample obtained using this method is generally referred to as a core sample. Once the core sample has been transported to the surface, it may be analyzed to assess the reservoir storage capacity (porosity) and the flow potential (permeability) of the material that makes up the formation; the chemical and mineral composition of the fluids and mineral deposits contained in the pores of the formation; and the irreducible water content of the formation material. The information obtained from analysis of a sample is used to design and implement well completion and production.

Several coring tools and methods of coring have been used. Typically, "conventional coring" is done after the drillstring has been removed from the wellbore, and a rotary coring bit with a hollow interior for receiving the core sample is lowered into the well on the end of a drillstring. A core sample obtained in conventional coring is taken along the path of the wellbore; that is, the conventional coring bit is substituted in the place of the drill bit, and a portion of the formation in the path of the well is taken as a core sample.

By contrast, in "sidewall coring" a core sample is taken from the side wall of the drilled borehole. Side wall coring is also performed after the drillstring has been removed from the borehole. A wireline coring tool that includes a coring bit is lowered into the borehole, and a small core sample is taken from the sidewall of the borehole. Multiple core samples may be taken at different depths in the borehole.

Sidewall coring is beneficial in wells where the exact depth of the target zone is not well known. Well logging tools, including coring tools, can be lowered into the borehole to evaluate the formations through which the borehole passes.

FIG. 1 shows an example of a prior art sidewall coring tool 101 that is suspended in a borehole 113 by a wireline 107 supported by a rig 109. A sample may be taken using a coring bit 103 that is extended from the coring tool 101 into the formation 105. The coring tool 101 may be braced in the borehole by a support arm 111. An example of a commercially available coring tool is the Mechanical Sidewall Coring Tool ("MSCT") by Schlumberger Corporation, the assignee of the present invention. The MSCT is further described in U.S. Pat. Nos. 4,714,119 and 5,667,025, both assigned to the assignee of the present invention.

There are two common types of sidewall coring tools, rotary coring tools and percussion coring tools. Rotary coring tools use an open, exposed end of a hollow cylindrical coring bit that is forced against the wall of the bore hole. The coring bit is rotated so that it drills into the formation, and the hollow interior of the bit receives the core sample. The rotary coring tool is generally secured against the wall of the bore hole by a support arm, and the rotary coring bit is oriented towards the opposing wall of the borehole adjacent to the formation of interest. The rotary coring bit typically is deployed from the coring tool by an extendable shaft or other mechanical linkage that is also used to actuate the coring bit against the formation. A rotary coring bit typically has a cutting edge at one end, and the rotary coring tool imparts rotational and axial force to the rotary coring bit through the shaft, other mechanical linkage, or hydraulic motor to cut the core sample. Depending on the hardness and degree of consolidation of the target formation, the core sample may also be obtained by vibrating or oscillating the open and exposed end of a hollow bit against the wall of the bore hole or even by application of axial force alone. The cutting edge of the rotary coring bit is usually embedded with carbide, diamonds or other hard materials for cutting into the rock portion of the target formation.

FIG. 2 shows a prior art rotary coring bit 201. The coring bit 201 includes a shaft 203 that has a hollow interior 205. A formation cutting element 207 for drilling is located at one end of the shaft 203. Many different types of formation cutting elements for a rotary coring bit are known in the art and may be used without departing from the scope of the invention. As the coring bit 201 penetrates a formation (not shown) and a sample core (not shown) may be received in the hollow interior 205 of the bit 201.

After the desired length of the core sample or the maximum extension of the coring bit is achieved, the core sample typically is broken from the formation by displacing and tilting the coring tool. FIG. 3 shows a prior art tool 301 used for collecting a core sample 304. The tool includes a rotary coring bit 303 with a formation cutting element 307 disposed at a distal end of the bit 303. "Distal end" refers to the end of the rotary coring bit 303 that is the farthest away from the center of the tool. The drill bit 303 is coupled to and driven by a motor 305 in the tool 301. FIG. 3 shows one method of severing the core sample 304 from the formation 313. The hydraulic arm 318 has retracted so that the motor 305 pulls the rotary coring bit 303 into a tilted position. The tilting breaks the core sample 304 from the formation 313.

After the core sample is broken free from the formation, the hollow coring bit and the core sample within the coring bit are retrieved into the coring tool through retraction of the coring shaft or mechanical linkage that is used to deploy the coring bit and to rotate the coring bit against the formation. Once the coring bit and the core sample have been retracted to within the coring tool, the retrieved core sample is generally ejected from the coring bit to allow use of the coring bit for obtaining subsequent samples in the same or in other formations of interest. When the coring tool is retrieved to the surface, the recovered core sample is transported within the coring tool for analysis and tests.

FIG. 4 shows a core sample 304 that has been retracted into a tool body 321 and ejected from the rotary coring bit 303 by a core pusher 311. The core pusher 311 pushes the core sample 304 out of the rotary coring bit 303 and into the sample container 309. A marker 316 may be used to separate the core sample 304 from a previously obtained sample 315 and any later obtained samples.

The second common type of coring is percussion coring. Percussion coring uses cup-shaped percussion coring bits that are propelled against the wall of the bore hole with sufficient force to cause the bit to forcefully enter the rock wall such that a core sample is obtained within the open end of the percussion coring bit. These bits are generally pulled from the bore wall using flexible connections between the bit and the coring tool such as cables, wires or cords. The coring tool and the attached bits are returned to the surface, and the core samples are recovered from the percussion coring bits for analysis.

SUMMARY OF INVENTION

In one or more embodiments, the invention is related to a coring bit comprising an outer hollow coring shaft and a rotationally uncoupled internal sleeve disposed inside the outer hollow coring shaft. In some embodiments, the uncoupled internal sleeve is non-rotating. In other embodiments, the uncoupled internal sleeve is free-floating.

In one or more embodiments, the invention is related to a downhole coring tool for taking a core sample from a formation comprising a tool body, an outer hollow coring shaft extendable from the tool body, an internal sleeve disposed inside the outer hollow coring shaft, and a tilting structure disposed inside the outer hollow coring shaft. The tilting structure may be operatively coupled to the internal sleeve to that the internal sleeve will tilt when fully extended from the tool body. In some embodiments, the tilting structure is a ramp block.

In one or more embodiments, the invention relates to a downhole coring tool for taking a core sample from a formation comprising a tool body, an outer hollow coring shaft extendable from the tool body, and a rotationally uncoupled internal sleeve disposed in the outer hollow coring shaft. In some embodiments, the uncoupled internal sleeve is non-rotating. In other embodiments, the uncoupled internal sleeve is free-floating.

In one or more embodiments, the invention relates to a method for taking a core sample comprising extending a coring bit into a formation, receiving the core sample in a rotationally uncoupled internal sleeve disposed inside the coring bit, and retrieving the core sample from the formation. In some embodiments, the method also includes tilting the coring bit and retracting the coring bit back into a tool body.

In one or more embodiments, the invention relates to a percussion coring bit comprising an outer hollow coring shaft, and an internal sleeve disposed inside the outer hollow coring shaft. The internal sleeve may be adapted to be removed from the outer hollow coring shaft with a core sample retained in the internal sleeve.

Other aspects and advantages of the invention will be apparent from the following description and the appended claims.

BRIEF DESCRIPTION OF DRAWINGS

FIGS. 6C and 6D show a cross-section of a coring tool with a retrieved core sample.

FIG. 7A shows an axial and radial cross-section of one embodiment of a gripping device in accordance with the invention.

FIG. 7B shows an axial and radial cross-section of one embodiment of a gripping device in accordance with the invention.

FIG. 7C shows an axial and radial cross-section of one embodiment of a gripping device in accordance with the invention.

FIG. 7D shows an axial and radial cross-section of one embodiment of a gripping device in accordance with the invention.

FIG. 7E shows an axial and radial cross-section of one embodiment of a gripping device in accordance with the invention.

FIG. 7F shows a radial cross-section of one embodiment of a gripping device in accordance with the invention.

FIG. 9A shows an axial and radial cross-section of one embodiment of a gripping device in accordance with the invention.

FIG. 9B shows an axial and radial cross-section of one embodiment of a gripping device in accordance with the invention.

DETAILED DESCRIPTION

The present invention, in one or more embodiments, relates to an uncoupled internal sleeve that receives and protects a sample core. An uncoupled internal sleeve may be non-rotating, and it may be free-floating. Optionally, in some embodiments, the sleeve may be permitted to rotate continuously, or at desired intervals.

Figure 5A:
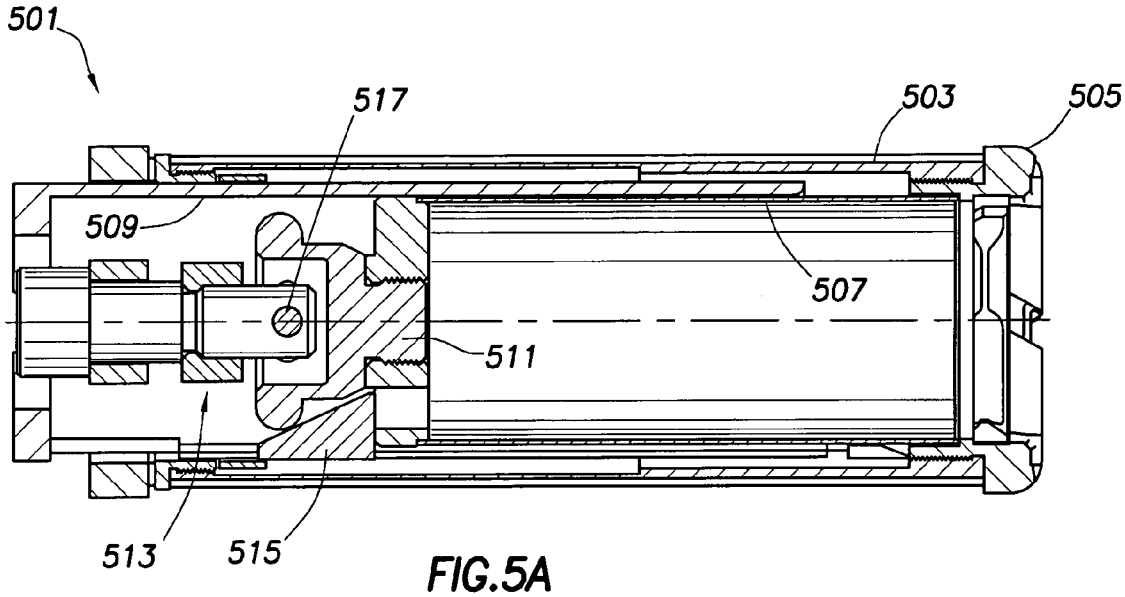
FIG. 5A shows a cross-section of a coring bit with an uncoupled sleeve in a retracted position.
Figure 5B:
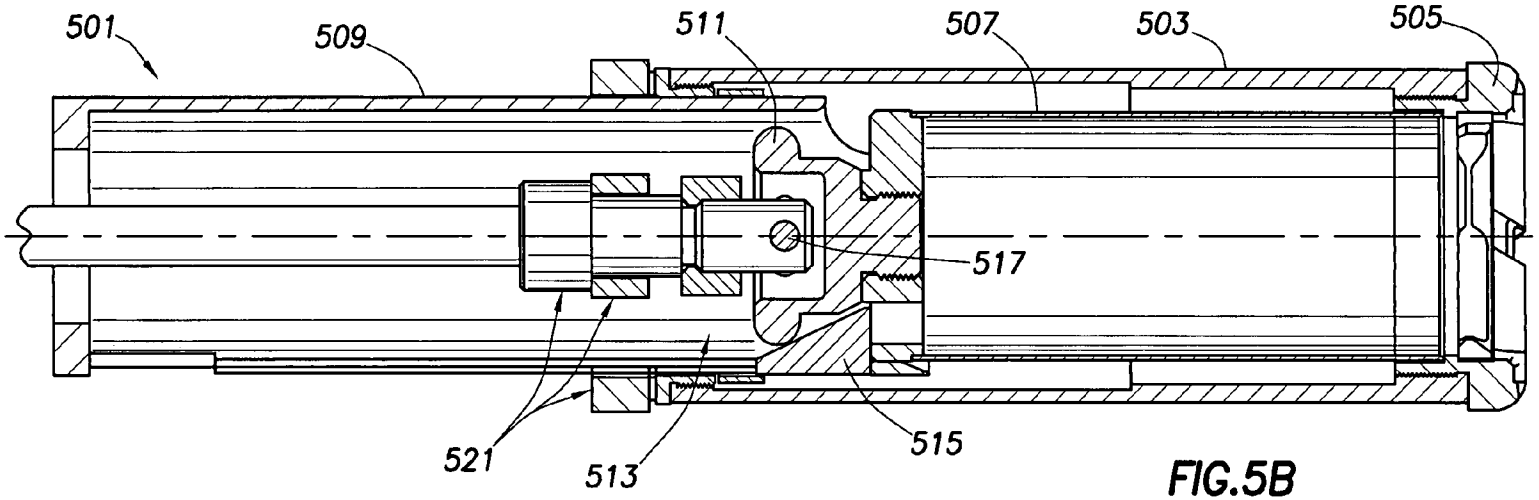
FIG. 5B shows a cross-section of a coring bit with an uncoupled sleeve in an extended position.
Figure 5C:
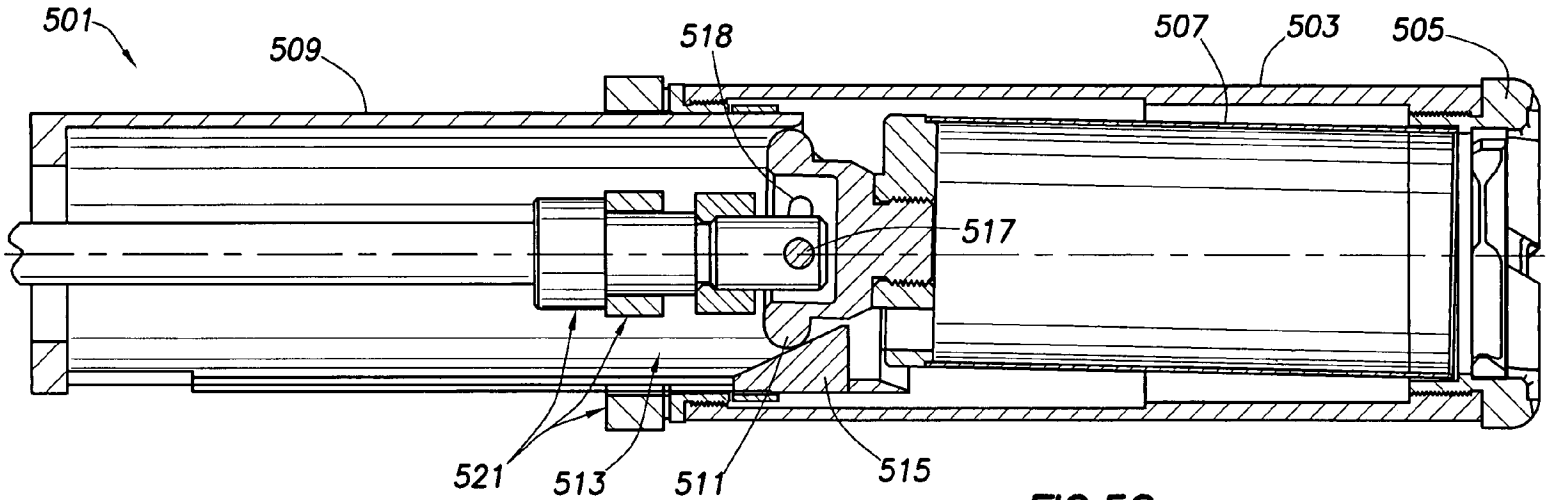
FIG. 5C shows a cross-section of a coring bit with an uncoupled sleeve in a tilted position.

FIGS. 5A-5C show cross-sections of a coring bit 501 in accordance with one embodiment of the invention in a retracted, an extended, and a tilted position. Each will now be described, using like reference numerals to identify like parts.

FIG. 5A shows a cross-section of a coring bit 501 in a retracted position. In a retracted position, the coring bit may reside entirely inside the body of a coring tool (not shown). The coring bit 501 includes an outer hollow coring shaft 503 with a formation cutting element 505 disposed on a distal end of the outer hollow coring shaft 503. The "distal" end of the shaft, as used herein, is the axial end of the outer hollow coring shaft 503 that is farthest away from the center of the tool, or the end that first contacts the formation. The "proximal" end, as used herein, is the other axial end of the outer hollow coring shaft 503. The outer hollow coring shaft 503 is hollow so that a core sample may be received in the bit 501. In some embodiments, a stationary support shaft 509 is disposed within the outer hollow coring shaft 503 to support and guide the uncoupled internal sleeve 507. The outer hollow coring shaft 503 may be adapted to axially slide along the support shaft 509.

The coring bit 501 may also include an uncoupled internal sleeve 507. The uncoupled internal sleeve 507 is disposed inside the outer hollow coring shaft 503. In some embodiments, the uncoupled internal sleeve 507 has an internal diameter that is substantially the same as the internal diameter of the formation cutting element 505. In some embodiments, the uncoupled internal sleeve 507 has an internal diameter that is larger than the internal diameter of the formation cutting element 505. In the embodiment shown in FIG. 5A, the outer diameter of the internal sleeve 507 is sized so that the uncoupled internal sleeve 507 can slide inside and be guided by the support shaft 509. The coring bit 501 is adapted so that a core sample may be received inside the uncoupled internal sleeve 507.

An "uncoupled" internal sleeve, as used herein, is a sleeve that is not rotationally coupled to the rotating parts of the coring tool, i.e., the outer shaft and the formation cutting element. In some embodiments, the internal sleeve is a "non-rotating" internal sleeve that does not rotate with respect to the coring tool. A non-rotating internal sleeve may be coupled to the coring tool in a manner so that it will not rotate. In some embodiments, the uncoupled internal sleeve is a "free-floating" internal sleeve. A free-floating internal sleeve is not rotationally coupled to the rotating parts of the coring tool, but it is free to rotate independently.

FIG. 5A also shows that a connector 511 at the proximal end of the uncoupled internal sleeve 507 is coupled to an extension member 513 by a pin 517. The pin 517 may also prevent the uncoupled internal sleeve 507 from rotating. The pin 517 may be coupled to the downhole tool (not shown) so that the uncoupled internal sleeve 507 will be non-rotating and will not rotate with respect to the coring tool (not shown). Other methods for extending a coring bit 501 and preventing the rotation of non-rotating internal sleeve 507 are known in the art and may be used without departing from the scope of the invention.

FIG. 5B shows a cross-section of a coring bit 501 in an extended position. In an extended position, an outer hollow coring shaft 503 and an uncoupled internal sleeve 507 are extended outside a tool body (not shown) and into a formation. The outer hollow coring shaft 503 is extended away from a coring tool (not shown). An annular formation cutting structure 505 and the uncoupled internal sleeve 507 have extended with the outer shaft 503. In some embodiments, the internal sleeve 507 is coupled to the tool (not shown) by a base attachment member 511 that is connected to a drive member 521 by a pin 517.

FIG. 5C shows a cross-section of a coring bit 501 in a tilted position. Near the end of the extension of the bit 501, the base attachment member 511 is pushed upward by a tilting device 515 (shown as a ramp block 515 in FIG. 5C). The uncoupled internal sleeve 507, in the extended position shown in FIG. 5C, is clear of the stationary support shaft 509, thereby enabling the tilting of the uncoupled internal shaft. The upward movement of the base attachment member 511 may cause the uncoupled internal sleeve 507 to tilt inside the outer hollow coring shaft 503. When the uncoupled internal sleeve 507 tilts, the pin 517 slides inside of slot 518. Such tilting may sever a core sample (not shown) received in the internal sleeve 507 from the remainder of the formation (not shown). In some embodiments, a tilting device 515, such as the ramp block 515, causes the uncoupled internal sleeve 507 to tilt from between about one and about five degrees. In some embodiments, the tilting device 515 causes the uncoupled internal sleeve 507 to tilt by about three degrees.

It will also be understood that the advantages of a tilting device 515 may be present even in embodiments of the invention where the internal sleeve is rotationally coupled to the rotating parts of the coring bit The advantages of a tilting device 515 may be realized without an uncoupled internal sleeve 507. Further, a ramp block is just one embodiment of a structure that causes an internal sleeve to tilt. For example, a cam may cause an internal sleeve to tilt. Also, a spring mechanism may be used to cause an internal sleeve to tilt when it clears the stationary support shaft.

Those having ordinary skill in the art will be able to devise other tilting structures that do not depart from the scope of the invention. While the tilting device 515 of FIG. 5 is depicted as a ramp block, other tilting devices, such as cams, diverters, guides, pin & slot devices or other mechanisms may also be used. Such a device may tilt the sample a sufficient amount to break the sample from the formation. The amount of tilting may be from about one to about five degrees, or other amounts depending on the available tilting room and/or the amount needed to cause sufficient breakage to release the sample.

In some embodiments, the sample core may be severed by other devices. For example, a clam type cutter included in a coring bit is disclosed in U.S. patent application Ser. No. 09/832,606, which is assigned to the assignee of the present invention. This application is hereby incorporated by reference. Other severing devices, including a clam cutter, may be used without departing from the scope of the invention.

Figure 6A:
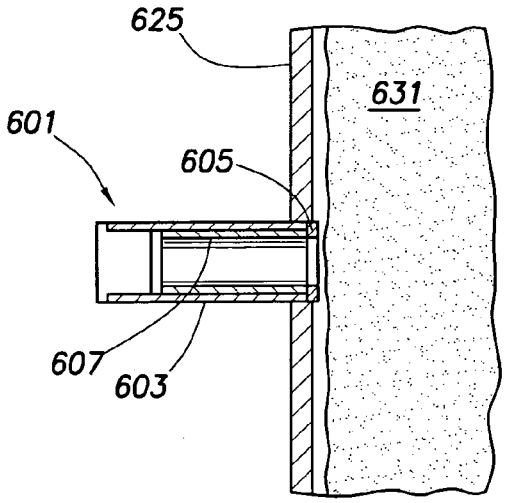
FIG. 6A shows a cross-section of a coring tool before taking a core sample.
Figure 6B:
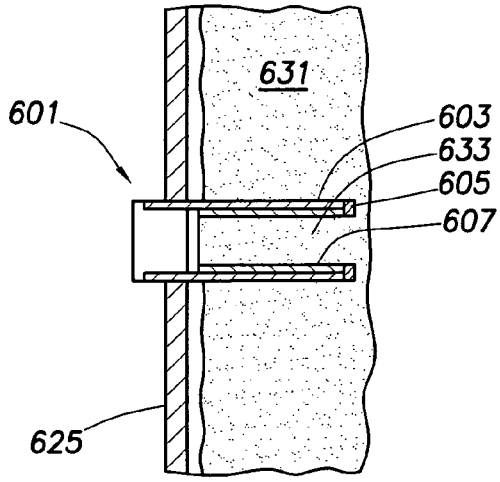
FIG. 6B shows a cross-section of a coring tool extended into a formation.

FIGS. 6A-6C illustrate a process of taking a core sample 633 from a formation 631 using a coring bit 601 according to one or more embodiments of the invention. It is noted that the coring bit 601 may be any type of coring bit, including a rotary coring bit, a percussion coring bit, or any other type of coring bit. Also, while the embodiments illustrated in FIGS. 6A-6C are for sidewall coring, those having ordinary skill in the art will be able to devise other embodiments that may include conventional coring of the bottom of a borehole.

FIG. 6A shows a cross-section of a coring bit 601 before taking a core sample from a formation 631. The bit 601 includes an outer hollow coring shaft 603 with a formation cutting element 605 disposed on a distal end of the outer hollow coring shaft 603. An internal sleeve 607 is disposed inside the outer hollow coring shaft 603, and the bit 601 is hollow so that it may receive a core sample. Prior to taking a sample, the bit is in a retracted position (similar to FIG. 5A), and the entire bit 601 may reside inside a tool body 625. It will be understood that FIGS. 6A6C show only one radial side of the tool body 625.

FIG. 6B shows a cross-section of a coring bit 601 in an extended position. In embodiments where the bit 601 is a rotary coring bit, the outer hollow coring shaft 603 will rotate, and the formation cutting element 605 will cut a cylindrical core sample 633 out of the formation 631. The uncoupled internal sleeve 607 may be a non-rotating internal sleeve or a free-floating internal sleeve. As the formation cutting element 605 cuts through the formation 631, the core sample 633 will pass into the uncoupled internal sleeve 607.

FIGS. 6C and 6D show a cross-section of a coring bit 601 where the core sample 633 has been removed from the formation 631 after severing. In FIG. 6C, the internal sleeve 607 is retracted from the formation 631 without retracting the coring shaft 603. In FIG. 6D, the internal sleeve 607 and the coring shaft 603 are retracted simultaneously. In FIGS. 6C and 6D, the uncoupled internal sleeve 607 stays with the core sample 633 as it is retrieved from the formation 631 and stored in the tool body 625. The outer hollow coring shaft 603 may remain extended into the formation 631, or retract within the sleeve 607, while the core sample 633, along with the internal sleeve 607, is retrieved and stored in the tool body 625. Once the core sample 633 is stored, the outer hollow coring shaft 603 can be retrieved from the formation 631, refitted with another internal sleeve, and made ready to take another core sample from a different location in the formation 631.

Figure 4:
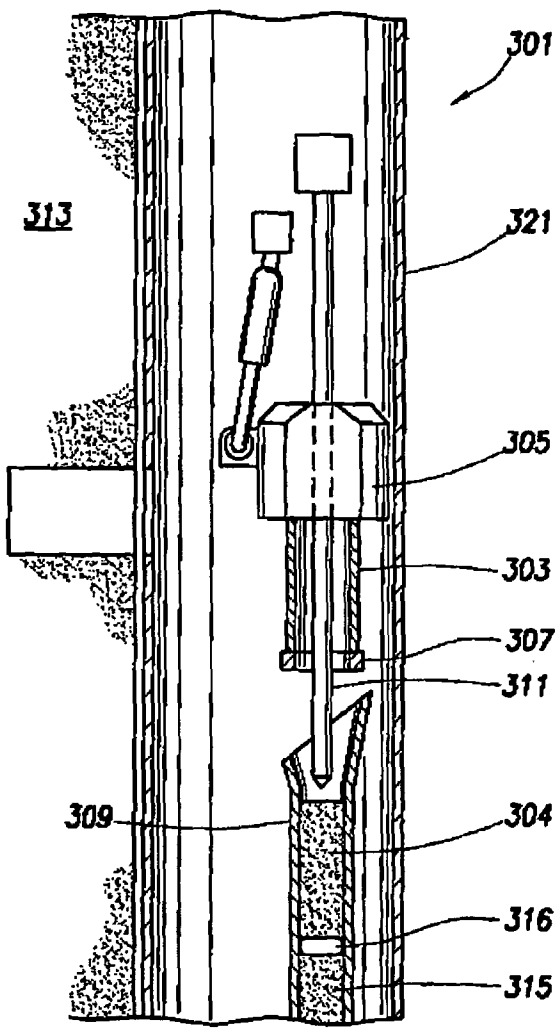
FIG.4 (PRIOR ART)
FIG. 4 shows a cross-section of one embodiment of a prior art coring tool with an ejected core sample.
Figure 3:
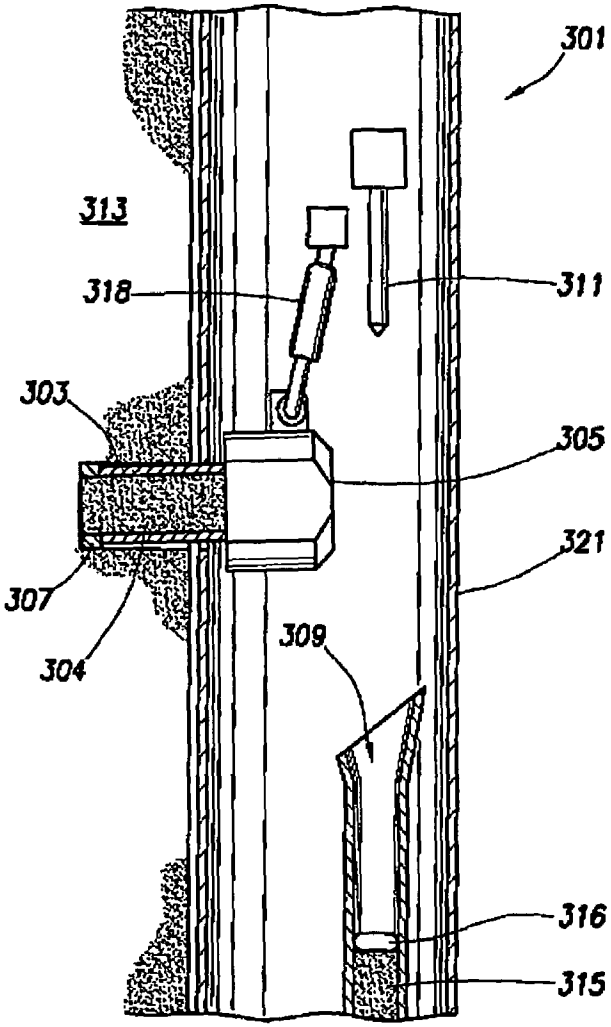
FIG.3 (PRIOR ART)
FIG. 3 shows a cross-section of one embodiment of a prior art coring tool in a tilted position.

Alternately, it is noted that the core sample 633 and the uncoupled internal sleeve 607 need not be retrieved while the outer hollow coring shaft 603 remains extended into the formation 633. For example, a tool may include a plurality of bits and each bit may store the sample that it receives during the sampling process. Also, the entire bit 601 may be retrieved into the tool body 625, and the bit 601 may be pivoted to a vertical position, similar to the position shown in prior art FIG. 4B. From the vertical position, a core pusher may push the internal sleeve 607, along with the core sample 633 received inside the internal sleeve 607, into a sample container. Those having ordinary skill in the art will be able to devise other methods of storing a core sample without departing from the scope of the invention.

In some embodiments, an uncoupled internal sleeve may be marked so that it can be identified from other sleeves. For example, a particular coring tool may be adapted to take ten core samples on a run into a wellbore. The ten uncoupled internal sleeves in the coring tool that will be used to collect core samples may be marked sequentially with the numbers one through ten. When the coring tool is retrieved, a number five, for example, will positively identify the location from which the sample in the sleeve was taken as the fifth location in the run of the coring tool. A marking may include a bar code or a transceiver identifier. Those having ordinary skill in the art will be able to devise other numbering or marking schemes without departing from the scope of the invention.

Some embodiments of the invention may include a percussion coring bit. In these embodiments, the outer hollow coring shaft does not rotate. An internal sleeve may be able to be removed from the outer hollow coring shaft for core sample transportation. Many advantages of the present invention may be realized in such embodiments.

Another aspect of the invention relates to gripping a core sample once the core sample is received in the internal sleeve. Gripping prevents the core sample from rotating within the sleeve or falling out of the sleeve. FIGS. 7A7F show embodiments of coring bits that include gripping devices.

FIG. 7A shows an axial and a radial cross-section of an internal sleeve 701 with elongated rectangular gripping protrusions 705. The sleeve 701 is comprised of a hollow cylindrical member 703 and rectangular protrusions 705 that protrude inward. The protrusions 705 may extend inward to such an extent that they contact a core sample as it enters the internal sleeve 701 and while the core sample is retained in the internal sleeve 701. The frictional engagement between the protrusions 705 and a core sample (not shown) enables the core sample to be gripped and retained in the internal sleeve 701. The geometry and degree of protrusion of the protrusions 705 may be selected based on a desired gripping or holding force to be placed on the core sample and the ability of the core sample to move into or out of the internal sleeve 701. Further, because the internal sleeve 701 is uncoupled from the rotating outer shaft, the damage to the core sample that may be caused by the protrusions 705 while the core sample is being received is minimized.

In some embodiments, the protrusions 705 are located near the distal end 707, or the open end that received a core sample, of the internal sleeve 701. In this configuration, the protrusions 705 grip the core sample as it enters the internal sleeve 701. Those having ordinary skill in the art will realize that the protrusions 705 may be located at any radial or axial location on the hollow cylinder 703 of the internal sleeve 701. For example, the protrusions 705 may be located near the proximal end 709 of the internal sleeve 701. In that position, the protrusions would grip a core sample only near the end of the sample taking process, when the sample core reaches the protrusions 705 near the proximal end of the internal sleeve 701.

Those having ordinary skill in the art will also realize that protrusions are not limited to the shape shown in FIG. 7A. FIGS. 7B-7E show radial and axial cross-sections of other embodiments of protrusions. FIG. 7B shows an internal sleeve 711 that has jagged internal protrusions 715 for gripping a core sample that protrude inward from a hollow cylinder 713. FIG. 7C shows an internal sleeve 721 that has spiked internal protrusions 725 for gripping a core sample that protrude inward from a hollow cylinder 723. FIG. 7D shows an internal sleeve 731 that has bumped internal protrusions 735 for gripping a core sample that protrude inward from a hollow cylinder 733. Those having ordinary skill in the art will be able to devise other types of internal protrusions that do not depart from the scope of the invention.

Further, an internal sleeve may contain more than one type of protrusion. FIG. 7E shows an internal sleeve 741 that includes many types of internal protrusions that protrude inward from a hollow cylinder 743, including elongated internal protrusions 705, jagged internal protrusions 715, spiked internal protrusions 725, and bumped internal protrusions 735. Any other protrusions may be included without departing from the scope of the invention.

FIG. 7F shows a radial cross-section of an internal sleeve 751 that has bristles 755 that extend inward from a hollow cylinder 753 to grip a core sample and retain it in the internal sleeve 751. The bristles 755 may be constructed of an elastic material or other suitable material.

Figure 8A:
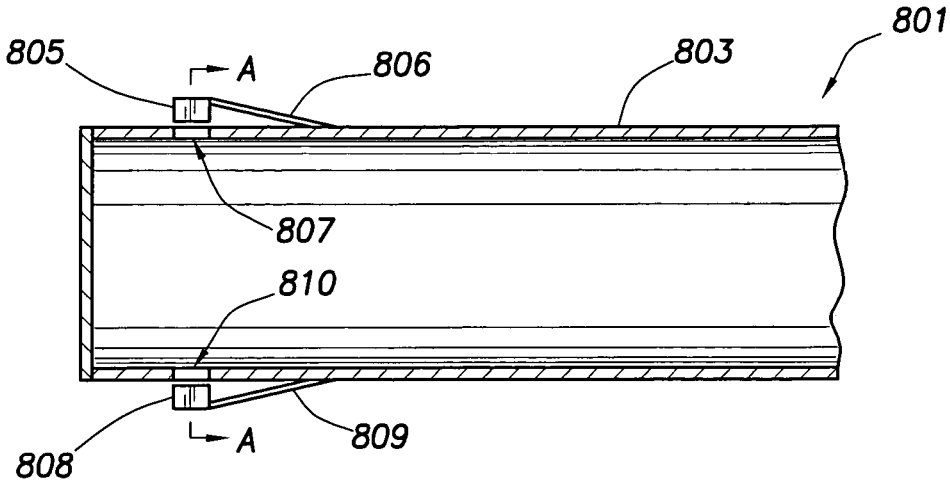
FIG. 8A shows an axial cross-section of one embodiment of an external gripping device in accordance with the invention.
Figure 8B:
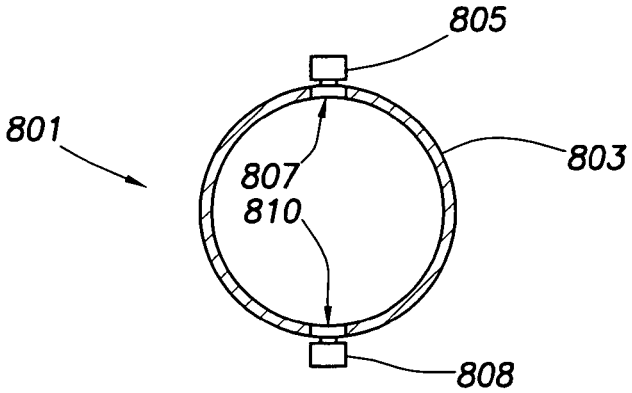
FIG. 8B shows a radial cross-section of one embodiment of an eternal gripping device in accordance with the invention.
Figure 8C:
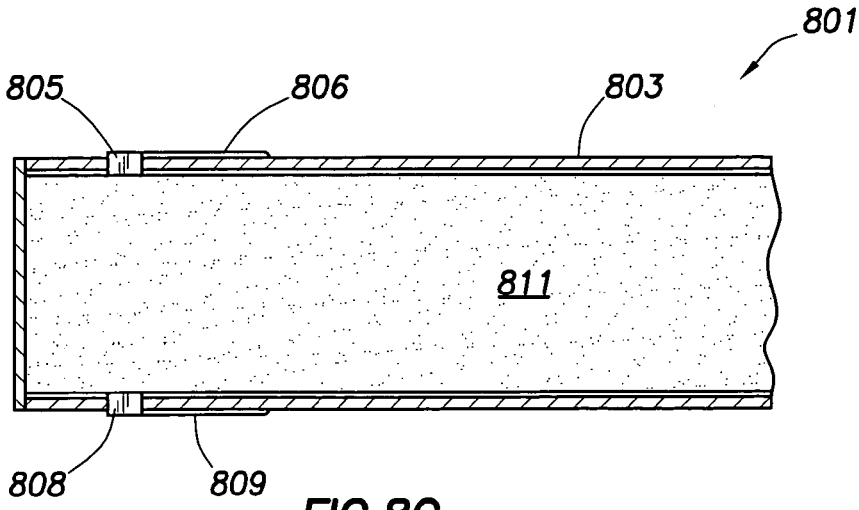
FIG. 8C shows an axial cross-section of one embodiment of an external gripping device in accordance with the invention.

FIGS. 8A-8C show another embodiment of a core sample gripping device. FIG. 8A shows an axial cross-section of an internal sleeve 801 with external protrusions 805, 808. A first external protrusion 805 is coupled to a hollow cylinder 803 of the internal sleeve 801 by a first support member 806. The first protrusion 805 may be positioned proximate a first opening 807 in the hollow cylinder 803. Likewise, a second protrusion 808 is coupled to the hollow cylinder 803 by a second support member 809, and the second protrusion 808 may be positioned proximate a second opening 810 in the hollow cylinder 803.

FIG. 8B shows a radial cross-section of the internal sleeve 801 shown in FIG. 8A along line A-A. The first protrusion 805 is shown positioned above the first opening 807. The first protrusion 805 may be moved into the first opening 807 so that it protrudes into the hollow cylinder 803. The second external protrusion 808 is shown positioned below the second opening 810. The second protrusion 808 may be moved into the second opening 810 so that it protrudes into the hollow cylinder 803. Additional members may be added circumferentially as desired.

FIG. 8C shows an axial cross-section of an internal sleeve 801 with a core sample 811 positioned inside the hollow cylinder 803. The external protrusions 805, 808 have been moved into their respective openings 807, 810 so that the protrusions 805, 808 protrude into the hollow cylinder 803 and contact the core sample 811. The friction between the protrusions 805, 808 and the core sample 811 retains the core sample 811 inside the internal sleeve 801.

The protrusions 805, 808 may be moved by any means known in the art. For example, a rigid part or parts (not shown) of a coring bit or coring tool (not shown) may be positioned so as to contact the protrusions 805, 808 or their support members 806, 809 as the internal sleeve 801 is extended into a formation to collect a sample. Those having ordinary skill in the art will be able to devise other methods of moving external protrusions without departing from the scope of the invention.

While FIGS. 8A-8C show only two external protrusions 805, 808, that is not intended to limit the invention. A single external protrusion or three or more external protrusions may be used without departing from the scope of the invention. Additional protrusions may be located at other positions around the circumference of the internal sleeve 803. Additional protrusion may also be located at different axial positions. The number and positions of external protrusions is not intended to limit the invention.

FIG. 9A shows an embodiment of a sample core gripping device in accordance with the invention. An internal sleeve 901 includes a hollow cylinder 903 with a longitudinal slot 902 along its surface. The slot 902 enables the internal sleeve 901 to be radially compressed or expanded. In some embodiments, the internal sleeve 901 may receive a core sample (not shown), and then the cylinder 903 may be constricted into a frictional engagement with the core sample.

In one embodiment, such as the one shown in FIG. 9A, the hollow cylinder may be tapered to have different diameters at the proximal 906 and distal 905 ends. The distal end 905 has a diameter that is at least slightly larger than the internal diameter of the formation cutting element (not shown). A core sample may freely enter the internal sleeve 901 because the diameter of the hollow cylinder 903 is larger than the diameter of the core sample (not shown). The proximal end 906, however, may have an internal diameter that is smaller than the internal diameter of the formation cutting element (not shown). Thus, a core sample would form a tolerance fit with the proximal end of the hollow cylinder 903 as the core sample is being received in the internal sleeve 901. The core sample (not shown) would force the hollow cylinder 903 to expand as it is received, thereby increasing the gripping force, as the sample core is received.

The slot 902 shown in FIG. 9A need not be an empty gap. A slot may comprise a material to close the slot, but that still enables the internal sleeve 903 to constrict around a core sample. For example, an elastomeric material may be disposed in the slot 903. Also, a metallic material may be used that is thin or predisposed to bend when the internal sleeve 903 is constricted. The material that may be present in the slot 903 is not intended to limit the invention.

A hollow cylinder need not include a slot, as shown in FIG. 9A. For example, FIG. 9B shows an internal sleeve 911 where the longitudinal ends 915, 917 of a hollow sleeve 913 overlap. The internal sleeve 911 could be compressed or expanded to grip a core sample (not shown). Also, an overlapping hollow cylinder 913 may be tapered so that a core sample may freely enter the cylinder 913 but will form a tolerance fit with the smaller radius of the cylinder 913 as the sample is received.

Figure 10:
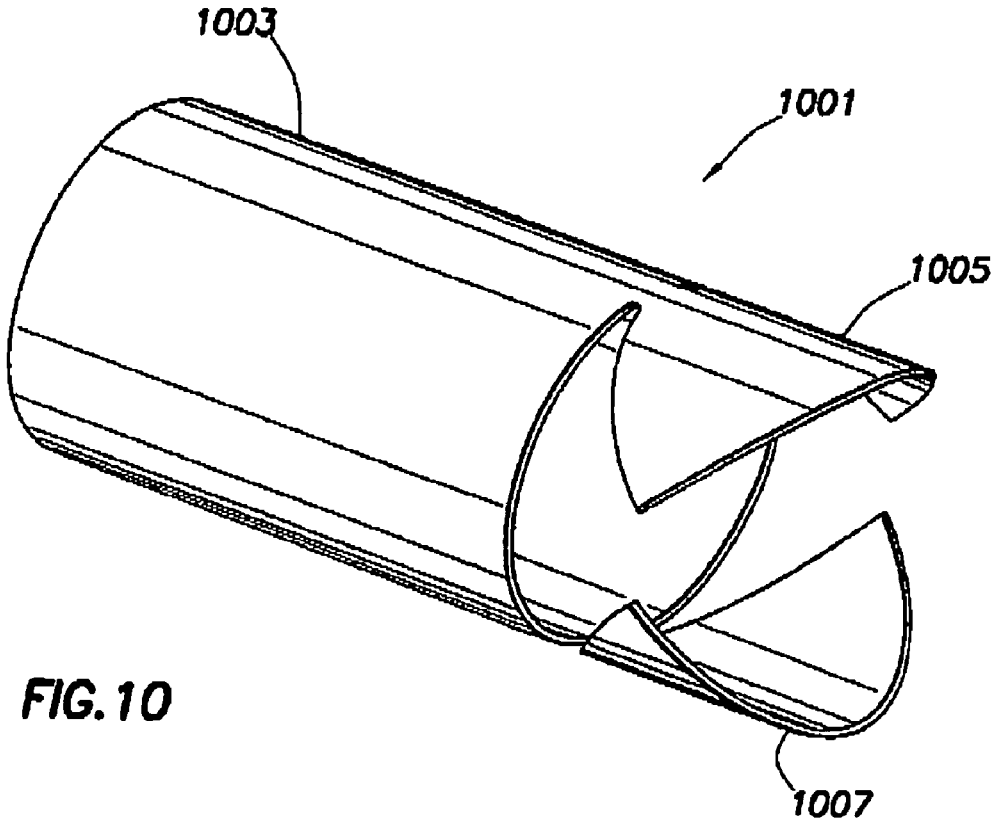
FIG. 10 shows an axial and radial cross-section of one embodiment of a gripping device in accordance with the invention.

FIG. 10 shows an embodiment of a sample core gripping device 1001. The device 1001 includes clam grippers 1005, 1007 at an end of an internal sleeve 1003. The clam grippers 1005, 1007 are similar to the clam cutters disclosed in U.S. patent application Ser. No. 09/832,606, but in this embodiment, the grippers 1005, 1007 may not close completely. Near the end of the core drilling process, rigid structures (not shown) in the outer shaft cause the grippers 1005, 1007 to partially close and retain the sample core in the internal sleeve 1003. In some embodiments, for example those using a clam type cutter, the clam grippers may close completely. In other embodiments, the clam grippers may partially close to grip a core sample.

Figure 1:
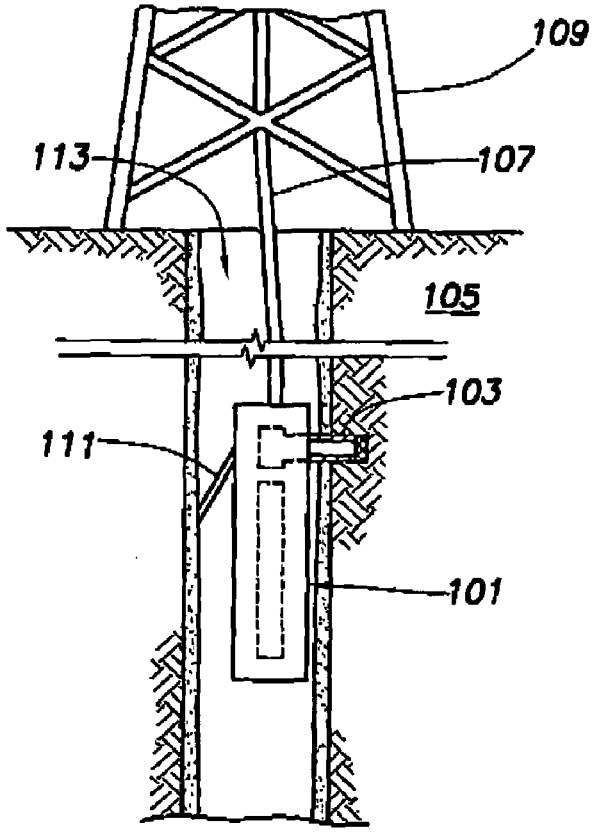
FIG. 1 (PRIOR ART)
FIG. 1 shows a cross-section of a prior art coring tool suspended in a well.
Figure 11A:
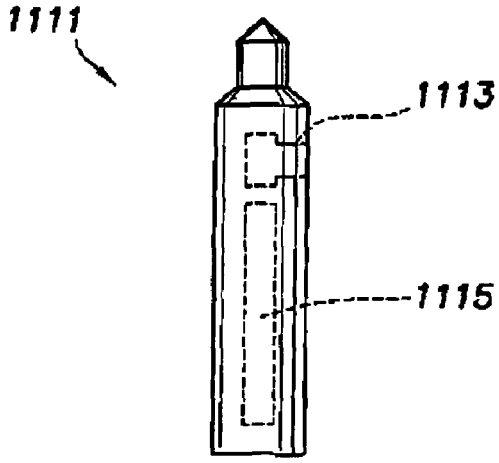
FIG. 11A shows a cross-section of one embodiment of a coring tool with a single coring bit.
Figure 11B:
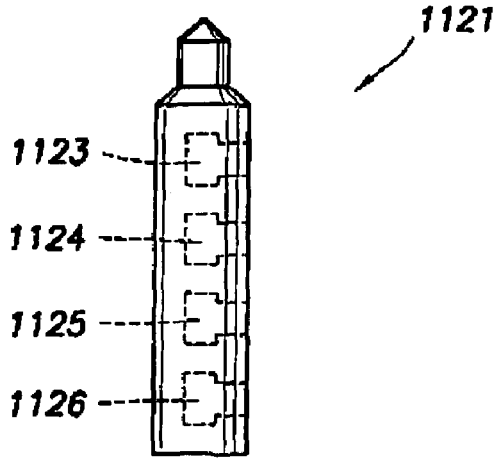
FIG. 11B shows a cross-section of one embodiment of a coring tool with a plurality of coring bits.
Figure 2:
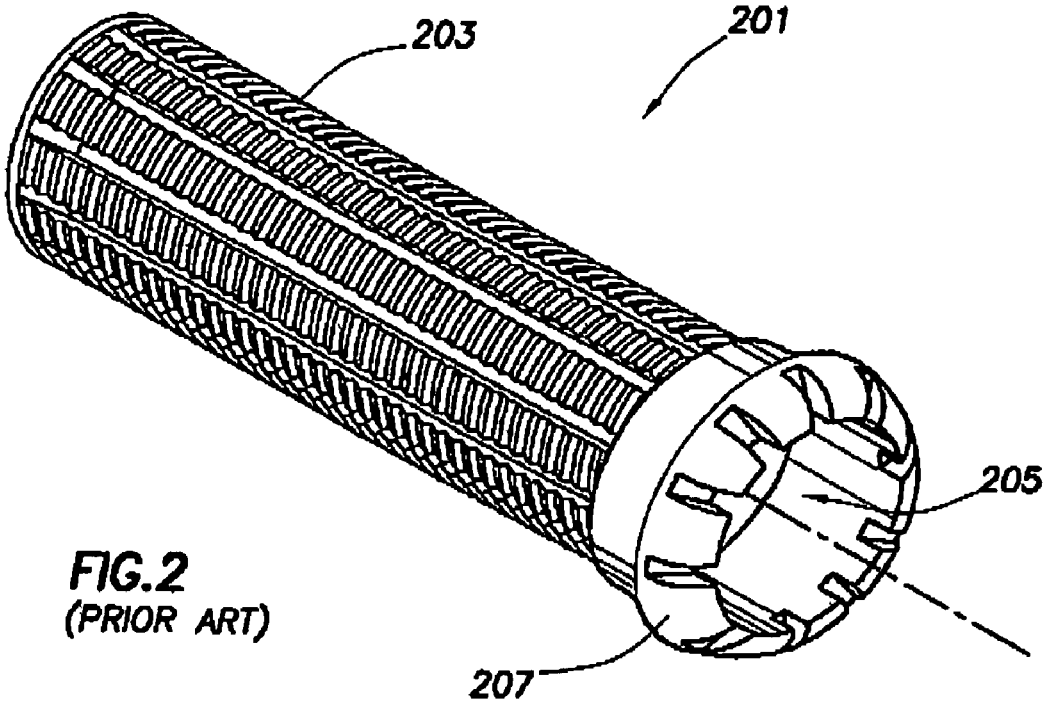
FIG.2 (PRIOR ART)
FIG. 2 shows a perspective view of a prior art rotary coring bit.

Embodiments of an uncoupled internal sleeve may be used in different types of coring tools. For example, there are several common configurations for sidewall coring tools. FIG. 11A shows one type of coring tool 1111 that includes a coring bit 1113 and a sample container 1115. Samples are taken by extending the coring bit 1113 into a formation (not shown), and the samples are then stored in the sample container. FIG. 11B shows another configuration for a coring tool 1121. The coring tool 1121 includes a plurality of coring bits 1123, 1124, 1125, 1126. Each of the bits 1123, 1124, 1125, 1126 may be used to collect and store a single sample. The type of coring tool and the number of coring bits in a coring tool are not intended to limit the invention.

One or more embodiments of the present invention may provide certain advantages. These advantages may include maintaining core integrity while drilling, retrieving, storing, and transporting a core sample. Some embodiments may include a non-rotating sleeve so that a core sample is not subjected to the rotation of the coring bit throughout the entire drilling process. Once a sample is drilled by a rotating formation cutting element, the sample will pass into the coring bit and into the non-rotating sleeve. The non-rotating sleeve will protect the sample from damage that may be caused by the rotation of other parts of the coring bit. This is especially advantageous in unconsolidated formations, where a rotating coring bit may cause the core sample to fall apart or erode. A rotating coring bit may contact the core sample as the sample is being taken, and the friction applied to the core sample may erode part of the sample. Further, even if a rotating coring bit does not directly contact a core sample, the rotation of the bit may cause a fluid, for example drilling mud, present in the borehole or formation to flow around the core sample in the gap between the core sample and the coring bit. Such fluid flow may erode the core sample. A protective internal sleeve may prevent erosion damage to the core sample.

Embodiments of the invention that include a free-floating internal sleeve may protect a core sample from the rotation of other parts of the bit. Advantageously, a free-floating internal sleeve may rotate with a sample if a core sample were to be severed from a formation before the completion of the sample taking process. When premature severing occurs, the core sample may rotate in the coring bit due to the rotation of the formation cutting element. A free-floating internal sleeve may rotate along with the sample, thereby protecting it from damage caused by friction and fluid erosion.

Advantageously, an uncoupled internal sleeve enables the safe removal of samples from the coring tool. The coring tool itself does not need to be transported to the analysis site to protect the samples in the coring tool. Instead, an uncoupled internal sleeve may be removed from the tool with a core sample stored inside the uncoupled internal sleeve. An uncoupled internal sleeve enables a core sample to be removed from a coring tool and transported to an analysis site without any direct contact with the core sample. Only the uncoupled internal sleeve is handled in the removal and transporting of samples. The uncoupled internal sleeve may protect the sample from damage caused by a core pusher during ejection, a sample container or marker during storage, or the weight of other samples above the core sample in a sample container.

Advantageously, a ramp block, if included, enables the uncoupled internal sleeve to be tilted without tilting the remainder of the coring bit. The coring tool does not require a mechanism to tilt the coring bit. Instead, a ramp block may cause the uncoupled internal sleeve to independently tilt.

Further, in a coring tool where the samples are removed from the coring bit and stored within the tool, an internal sleeve in accordance with one or more embodiments of the invention enables a positive identification of the depth at which each sample was taken. Even if an unconsolidated sample is stored, or if a stored sample is otherwise destroyed, an internal sleeve would occupy space in the sample container so that an accurate depth of other samples may be determined. Embodiments where the internal sleeve is individually marked enable a positive identification of the location from which the core sample in the internal sleeve was taken by looking only at the marking on the internal sleeve.

Advantageously, embodiments of the invention that include a core sample gripping device enable an internal sleeve to retain a core sample in the internal sleeve while minimizing the damage to the core sample. The sample may be retrieved from the formation, transferred into a sample container within a coring tool, and removed from the tool at the surface for transportation to an analysis site while being retained in the internal sleeve. Thus, an internal sleeve enables protection of a core sample at all phases of the drilling, severing, retrieving, storing, removing, and transporting processes.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

We claim:

1. A coring bit, comprising:

an outer hollow coring shaft extendable through a side of a wellbore; and a rotationally uncoupled internal sleeve disposed inside the outer hollow coring shaft, wherein the internal sleeve is retractable from the outer hollow coring shaft into a downhole tool in a downhole environment; and a tilting structure disposed inside the coring bit, wherein the tilting structure causes the internal sleeve to tilt when the internal sleeve reaches an extended position.

2. The coring bit of claim 1, wherein the coring bit is adapted to take a core sample from a sidewall of a formation.

3. The coring bit of claim 1, wherein the uncoupled internal sleeve is non-rotating.

4. The coring bit of claim 1, wherein the uncoupled internal sleeve is free-floating.

5. The coring bit of claim 1, further comprising a formation cutter disposed at a distal end of the outer hollow shaft, and wherein the outer hollow coring shaft is adapted to rotate with respect to the formation.

6. The coring bit of claim 5, wherein the internal sleeve has an internal diameter that is substantially identical to an internal diameter of the formation cutter.

7. The coring bit of claim 5, wherein the internal sleeve has an internal diameter that is larger than an internal diameter of the formation cutter.

8. The coring bit of claim 1, wherein the tilting structure comprises a ramp block.

9. The coring bit of claim 1, wherein the tilting structure comprises a cam.

10. The coring bit of claim 1, wherein the uncoupled internal sleeve comprises an identification marker.

11. A downhole coring tool for taking a core sample from a formation, comprising:

a tool body; an outer hollow coring shaft extendable from the tool body into the formation;

an internal sleeve disposed inside the outer hollow coring shaft; and a ramp disposed inside the outer hollow shaft and operatively coupled to the internal sleeve so that the internal sleeve will tilt when fully extended from the tool body.

12. The downhole coring tool of claim 11, wherein the internal sleeve is rotationally uncoupled.

13. The downhole coring tool of claim 12, wherein the internal sleeve is non-rotating.

14. The downhole coring tool of claim 12, wherein the internal sleeve is free-floating.

15. A downhole coring tool for taking a core sample from a formation, comprising:

a tool body;

an outer hollow coring shaft disposed in the tool body and extendable from the tool body and into the sidewall of a wellbore; and a rotationally uncoupled internal sleeve disposed in the outer hollow coring shaft, wherein the internal sleeve is retractable from the outer hollow coring shaft into the tool body in a downhole environment; and a tilting structure disposed inside the coring bit, wherein the tilting structure causes the internal sleeve to tilt when the internal sleeve reaches an extended position.

16. The downhole coring tool of claim 15, further comprising a formation cutting element disposed at a distal end of outer hollow coring shaft.

17. The downhole coring tool of claim 15, wherein the coring bit is adapted to take a core sample from a sidewall of a formation.

18. The downhole coring tool of claim 15, wherein the uncoupled internal sleeve is non-rotating.

19. The downhole coring tool of claim 15, wherein the uncoupled internal sleeve is free-floating.

20. The downhole coring tool of claim 15, further comprising a formation cutter disposed at a dial end of the outer hollow coring shaft, and wherein the outer hollow coring shaft is adapted to rotate with respect to the formation.

21. The downhole coring tool of claim 20, wherein the internal sleeve has an internal diameter that is substantially identical to an internal diameter of the formation cutter.

22. The downhole coring tool of claim 20, wherein the internal sleeve has an internal diameter that is larger than a internal diameter of the formation cutter.

23. The downhole coring tool of claim 15, wherein the tilting structure comprises a ramp block.

24. The downhole coring tool of claim 15, wherein the tilting structure comprises a cam.

25. A method for taking a core sample, comprising:

extending a coring bit having a tilting structure disposed inside the coring bit, through a sidewall of the wellbore and into a formation;

receiving the core sample in an uncoupled internal sleeve disposed inside the coring bit;

retrieving the core sample from the formation in the internal sleeve; and retracting the internal sleeve with the sample from the coring bit in a downhole environment.

26. The method of claim 25, wherein the extending the coring bit comprises boring an outer hollow coring bit into the formation, the outer hollow coring bit disposed external to the inner uncoupled sleeve.

27. A percussion coring bit, comprising:

an outer hollow coring shaft extendable through a sidewall of a wellbore; said shaft being stationary during sampling; and an internal sleeve disposed inside the outer hollow coring shaft, wherein the internal sleeve is adapted to be removed from the outer hollow coring shaft with a core sample retained inside the internal sleeve while the percussion coring bit is in the wellbore.

* * * * *